US005742970A

United States Patent [19]

Zurawin

[11] Patent Number: 5,742,970

[45] Date of Patent: Apr. 28, 1998

[54] COATER FOR APPLYING LIQUID

[75] Inventor: Michael Zurawin, New York, N.Y.

[73] Assignee: AdamsBrush Mfg. Co. Inc., Ozone Park, N.Y.

[21] Appl. No.: 758,585

[22] Filed: Nov. 27, 1996

[51] Int. Cl.[6] ..... B05C 17/02

[52] U.S. Cl. ..... 15/121; 15/230.11; 15/248.2; 492/13; 492/19

[58] Field of Search ..... 15/121, 230.11, 15/248.2; 492/13, 19

[56] References Cited

U.S. PATENT DOCUMENTS

| | | | |
|---|---|---|---|
| 2,887,711 | 5/1959 | Hutchinson | 15/230.11 |
| 3,274,637 | 9/1966 | Schulze | 15/230.11 X |
| 3,346,899 | 10/1967 | Murphy | 15/230.11 X |
| 3,378,872 | 4/1968 | Frontera et al. | 15/230.11 |
| 4,466,151 | 8/1984 | Barch et al. | 15/230.11 X |
| 4,569,099 | 2/1986 | Harding | 15/230.11 X |
| 4,985,958 | 1/1991 | Garcia | 15/230.11 X |
| 5,014,384 | 5/1991 | Brezette et al. | 15/230.11 |
| 5,018,236 | 5/1991 | Feldman | 15/230.11 |
| 5,507,066 | 4/1996 | Zulick | 15/230.11 |
| 5,509,165 | 4/1996 | Zigelboim et al. | 15/230.11 |

FOREIGN PATENT DOCUMENTS

| | | | |
|---|---|---|---|
| 602303 | 8/1994 | European Pat. Off. | 15/230.11 |
| 268396 | 4/1913 | Germany | 15/230.11 |

*Primary Examiner*—Mark Spisich
*Attorney, Agent, or Firm*—Graham & James LLP

[57] ABSTRACT

An improved coater includes a handle, a frame attached to the handle, a roller rotatably housed within the frame, wherein the roller has a substantially increased width and pile height for more quickly and accurately spreading a coating liquid to a surface. The frame includes a spatter shield having a first radius of curvature larger than the diameter of the roller and a squeegee member having a radius of curvature which is less than the radius of curvature of the spatter shield and which extends in a direction opposite to the radius of curvature of the spatter shield.

7 Claims, 2 Drawing Sheets

COATER FOR APPLYING LIQUID

BACKGROUND OF THE INVENTION

This invention relates to an improved coater for use in applying a liquid such as a deck sealer, a driveway sealer or paint to a surface, and more specifically, to an improved coater having a roller having an increased width and pile height and a roller cover comprising an integral spatter shield, a squeegee and a roller well for accommodating an increased pile height fabric roller.

DESCRIPTION OF RELATED ART

Many conventional coaters for applying a liquid such as deck sealant, wood sealant, driveway sealant or paint include a roller mounted on a rotatable axis and a handle for moving the roller in a reciprocating manner on a surface to apply liquid to the surface. Such a roller is described in U.S. Pat. No. 5,509,165. This patent shows a roller having a spatter shield 36 for preventing the liquid being applied to a surface via the roller from being propelled away from the surface being coated and towards the user of the roller.

Such conventional coaters have several drawbacks. The conventional coaters usually include a relatively short-width roll which substantially increases the time and effort required for completing a coating job. In addition, the depth of pile of the roller fabric is usually relatively small being in the range of about ¼ inch pile or less. This also substantially increases the time required for completing a coating application job. These relatively small measurements, limit the amount of material that can be applied by the roller in a single application.

In addition, such conventional coaters do not include a squeegee for spreading a coating liquid. In rollers used for applying paint to walls, a squeegee is usually not necessary because the roller alone can sufficiently apply the paint to the walls. However, in coaters used for applying a liquid to a relatively large floor surface, such as a driveway, a deck, a floor to be painted, etc., a squeegee is useful for spreading the coating liquid before evenly applying the liquid to the surface using a roller. The conventional coaters for such applications of coating liquid to floor surfaces only include a roller and do not include a squeegee. Thus, such conventional coaters rely on the roll only for spreading the liquid on the surface. This leads to very uneven and time-consuming coating applications.

SUMMARY OF THE INVENTION

The preferred embodiments of the present invention overcome the problems with the conventional coaters described above by providing an improved coater having a substantially increased roller width and roller pile height and an improved spatter shield, including the novel combination of a spatter shield and squeegee wherein the spatter shield has a substantially increased curvature to accommodate the increased pile height of the roller fabric and the squeegee has a unique configuration for effectively distributing coating liquid while preventing undesired buildup of coating liquid at certain areas on the spatter shield.

According to one preferred embodiment of the present invention, the improved coater includes a handle attached to a roller axle via a frame member. Disposed on the roller axle is a roller having a substantially increased width and pile height. Preferably, the width of the roller is about 20 inches and the pile height of the roller is about ½ of an inch to 1.5 inches. The frame preferably comprises a spatter shield for covering an outer portion of the roller located closest to the handle. The spatter shield preferably has an increased radius of curvature of about 1 to 2 inches for accommodating the higher pile height fabric of the roller. The spatter shield also preferably includes an integral squeegee member for evenly distributing a coating fluid before using the roller to apply the coating fluid to a surface. The squeegee member preferably has a radius of curvature extending in a direction opposite to direction of the radius of curvature of the spatter shield which surrounds the roller. The radius of curvature of the squeegee member is preferably less than the radius of curvature of the spatter shield.

The squeegee member is preferably located at one end or edge portion of the spatter shield which corresponds to an end of the roller that is not in contact with a surface to be coated when the roller is being used to apply the coating liquid to the surface. When the squeegee member is being used to apply coating liquid before the roller is used, the operator grips the handle of the coater in such a manner that the squeegee member is closest to the operator and the end portion of the spatter shield disposed opposite to the portion of the frame having the squeegee member is located farthest away from the operator. After the coating fluid has been evenly distributed on a surface, the coater roller is used to apply the coating fluid in a sufficiently thick coating onto the surface. When switching from using the squeegee member to evenly distribute the coating fluid to using the roller member to apply the fluid to the surface, the operator reverses the direction which the handle is held such that the roller is closest to the operator and the squeegee member is farthest away from the operator. This arrangement of the squeegee member, roller and spatter shield prevents the squeegee member from interfering with the roller applying the coating liquid to the surface.

In a preferred embodiment, the roller member preferably has a 20-inch width and a pile height of about ½ inch to 1.5 inches. With such an increased pile height, the coating liquid is more evenly and uniformly distributed to the surface, even if the surface has uneven portions including indents, cracks, curvatures and abnormal surface characteristics and defects. The substantially increased width and increased pile height greatly decreases the time required for completing a coating liquid application job and improves the uniformity of the coating application.

Other advantages of the preferred embodiments of the present invention will become apparent from the following description of the preferred embodiments of the present invention which are shown in the accompanying drawings.

DETAILED DESCRIPTION OF PREFERRED EMBODIMENTS

Figure 1:
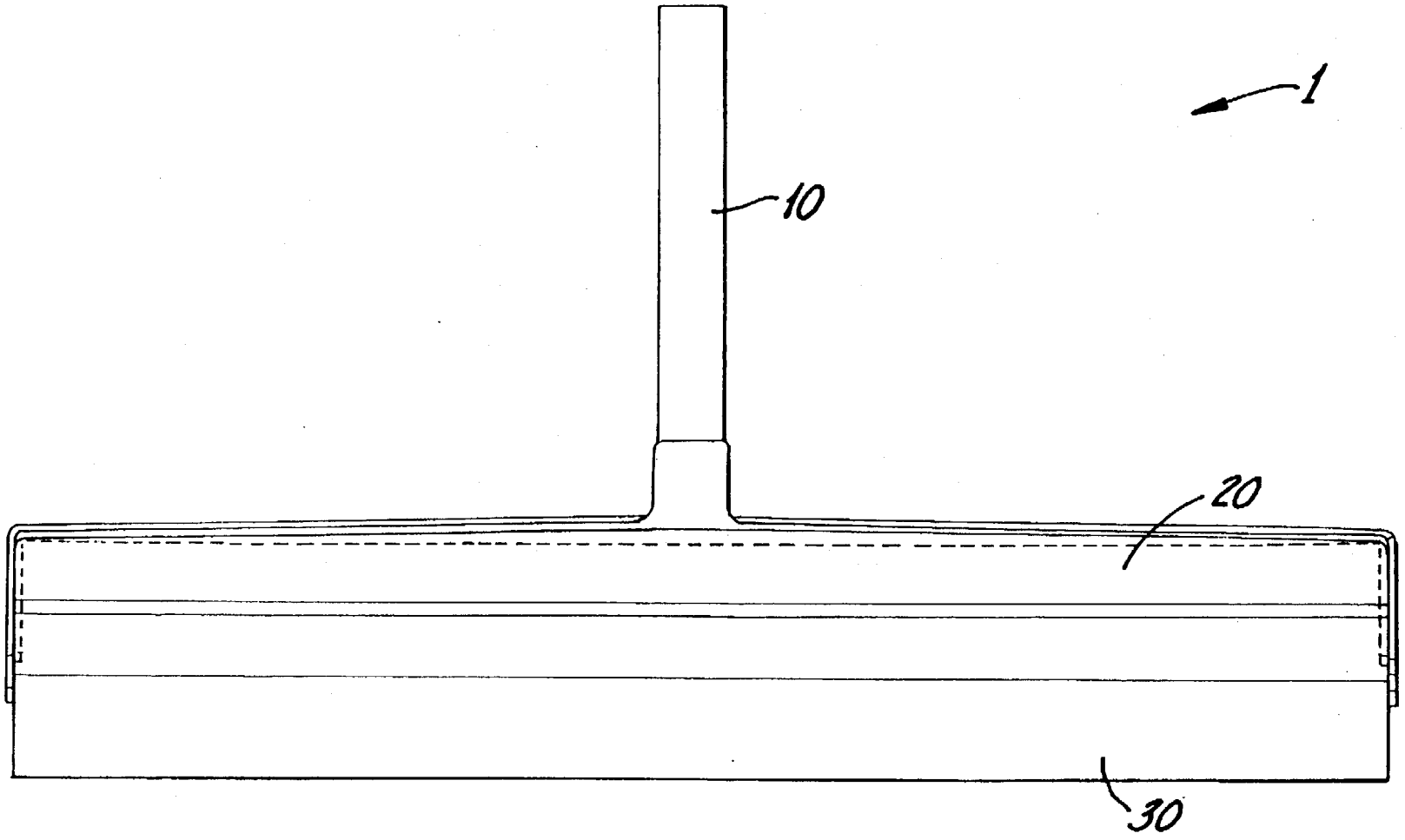
FIG. 1 is a schematic front view of the improved coater according to a preferred embodiment of the present invention.

A preferred embodiment of the present invention is shown in FIG. 1. FIG. 1 shows an improved coater 1, including a handle 10, attached to a frame 20, and having a roller 30 mounted thereon. The handle 10 preferably comprises a wooden, metal or other suitable material member which is connected to the frame 20 via a threaded engagement, a force-fit or other known connection.

Figure 2:
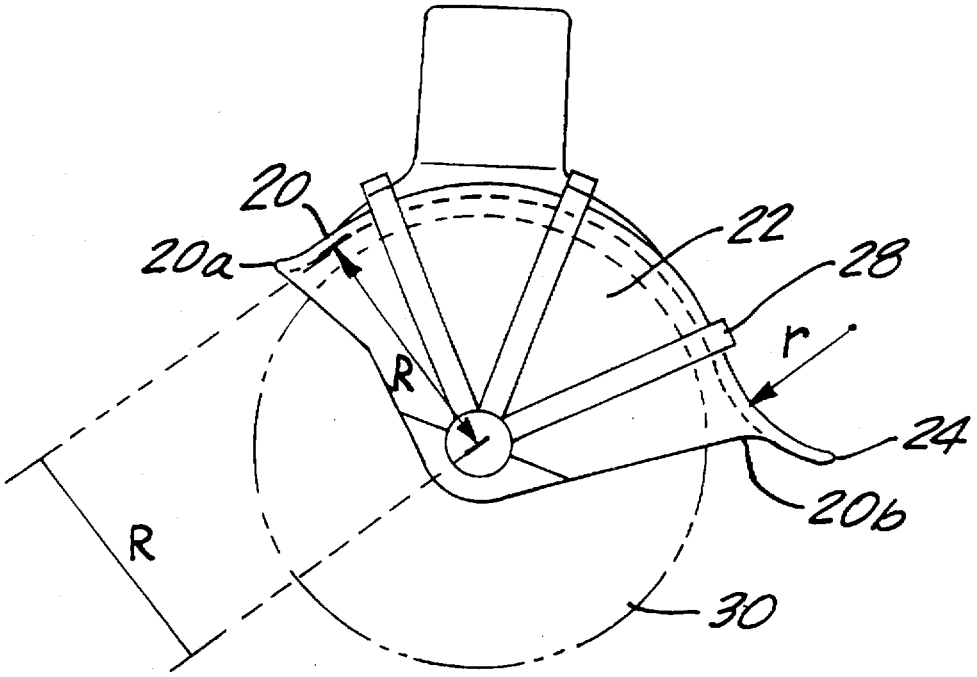
FIG. 2 is a side view of the improved coater shown in FIG. 1.

Referring also to FIG. 2, the frame 20 preferably comprises a spatter shield 22 having a radius of curvature R. The radius of curvature R is preferably about 1 to 2 inches so as to accommodate the increased pile height of the roller as described below.

The spatter shield 22 preferably extends for about 100 degrees to 180 degrees in a preferred embodiment but may even extend further if necessary. The spatter shield 22 is disposed and arranged relative to the roller 30 to prevent coating liquid being applied to a surface via the roller 30 from spattering in a direction opposite to the surface and back toward the operator of the coater 1.

The frame 20 also preferably includes a squeegee member 24 which forms an integral unit with the spatter shield 22. That is, the frame 20 is a single unitary member including both the spatter shield 22 and the squeegee 24. The squeegee member 24 preferably has a radius of curvature r of which may be about 0.25 to 0.5 inches. In another preferred embodiment, the squeegee may be formed from a planor surface, supported by the frame. The radius of curvature r extends in a direction opposite to the radius of curvature R of the spatter shield 22 surrounding the roller. The frame 20 preferably has an operator's side 20*a* which is disposed closest to the operator when the roller 30 is being used to apply the coating liquid to a surface. Disposed at the opposite end 20*b* of the frame 20 is the squeegee 24. Squeegee 24 is disposed at the opposite end 20*b* of frame 20 to prevent the squeegee 24 from interfering with the rotation of the roller 30 while the roller is applying liquid to a surface. When the squeegee 24 is to be used to distribute coating liquid before coating is to be applied via the roller 30, the handle 10 is held by the operator such that the squeegee 24 is disposed closest to the surface being coated, and end 20*a* is away from the surface.

The frame 20 also preferably includes a ridge or outer stop member 28 which is disposed on the outer surface of the frame 20 and in close proximity to the squeegee 24. The stop member 28 inhibits coating liquid which has been contacted by the squeegee member 24 from advancing onto the upper surfaces of the frame 20 and the spatter shield 22 which are close to the handle 10. Accordingly, when the squeegee member 24 is being used, the coating liquid may fill the radius of curvature R of the squeegee member 24, but the stop member 28 inhibits the coating liquid from advancing beyond the location of the stop member 28 to avoid the coating liquid from carrying coating liquid on undesired portions of the outer surface of the frame 20 and to prevent the coating liquid from entering into the connection between the handle 10 and frame 20 which may make it difficult to remove the frame 20 from the handle. This is undesirable because several different types of frames 10 having different size and shape rollers and spatter shields with integral squeegees may be engaged and disengaged to accommodate the need for various types of rollers and coaters.

The roller 30 preferably comprises a hollow circular roller member comprising an inner core and an outer coating surface formed of a suitable fabric. The radius and curvature of the squeegee member is preferably selected to more evenly distribute the coating fluid and allowing the coating fluid to gather in the radius of curvature. The width of the coating roller 30 is preferably about 20 inches.

The pile height of the fabric used for the roller is preferably about ½ to 1.5 inches in height. As a result of the increased width of the roller and height of the pile fabric, the improved coater 1 according to the preferred embodiments of the present invention substantially decreases the amount of time required for a coating application and also more evenly distributes the coating liquid in all areas of a surface including, cracks, crevices, surfaces defects, etc.

Although the present invention has been described in relation to particular preferred embodiments thereof, many variations and modifications in other uses will become apparent to those skilled in the art. It is preferred, therefore, that the present invention be limited not by the specific disclosure herein, but only by the appended claims.

What is claimed is:

1. An improved coating apparatus, comprising:

(a) an elongated handle;

(b) a roller;

(c) an elongated frame to which said handle is attached and oriented transverse with respect thereto and wherein said frame comprises a single unitary body having opposite ends between which said roller is rotatably mounted, said frame further including a curved spatter shield extending between the ends thereof and corresponding to the shape of the roller, said curved spatter shield further having an edge extending between said ends, and a curved squeege member extending from the edge of said spatter shield along substantially the entire length thereof, the radius of curvature of said squeege member being less than the radius of curvature of said spatter shield and further wherein the curvature of the squeege member faces in a direction opposite that of the curvature of the spatter shield.

2. The apparatus of claim 1, wherein the spatter shield has a radius of curvature of about 1 inch to about 3 inches.

3. The apparatus of claim 2, wherein the squeegee member has a radius of curvature of about 0.25 to 0.50 inches.

4. The apparatus of claim 1, wherein the roller comprises a pile fabric having a pile height of about 0.50 inches to 1.25 inches.

5. The apparatus of claim 1, wherein the roller has a width of about 20 inches.

6. An improved coating apparatus for coating a surface, comprising:

a frame having a single unitary body having opposite ends between which a roller is rotatably mounted and a spatter shield extending between the ends of the frame;

the spatter shield comprising substantially parallel fore and aft edges extending between the frame ends;

a squeegee member extending from the fore edge of said spatter shield along substantially the entire length thereof; an elongated handle being affixed to the frame and extending from the frame in a direction away from the axis of rotation of the rotatable mounted roller such that when the handle is positioned at an operational angle with respect to a surface to be coated, either i) the squeegee is in operative contact with the surface and the roller is not in contact with the surface, or (ii) the roller is in operative contact with the surface and the squeegee is not in contact with the surface, wherein the spatter shield comprises a curved member having a radius of curvature of about 1 inch to about 3 inches, wherein the squeegee member comprises a curved member having a radius of curvature of about 0.25 to 0.50 inches.

7. The apparatus of claim 6, wherein the curved member of the spatter shield has a shape substantially corresponding to the shape of the roller and the curved member of the squeege has a radius of curvature which extends in a direction opposite to a radius of curvature of the spatter shield.

* * * * *